US006688082B1

(12) United States Patent
Loperfido et al.

(10) Patent No.: US 6,688,082 B1
(45) Date of Patent: Feb. 10, 2004

(54) METHOD FOR STOPPING AND STARTING AN AUTOMATIC MACHINE FOR COLLECTIVELY WRAPPING PRODUCTS, ESPECIALLY ROLLS OF TOILET OR KITCHEN PAPER

(75) Inventors: Gianfranco Loperfido, Lugo (IT); Giampaolo Castaldini, Baricella (IT)

(73) Assignee: T.M.C. S.p.A., Bologna (IT)

( * ) Notice: Subject to any disclaimer, the term of this patent is extended or adjusted under 35 U.S.C. 154(b) by 0 days.

(21) Appl. No.: 10/371,660

(22) Filed: Feb. 21, 2003

(30) Foreign Application Priority Data

Jul. 26, 2002 (IT) ..... BO2002A0493

(51) Int. Cl.[7] ..... B65B 11/00

(52) U.S. Cl. ..... 53/461; 53/466; 53/55; 53/64; 53/228; 53/389.1; 53/389.2

(58) Field of Search ..... 53/461, 466, 55, 53/64, 67, 228, 389.1, 389.2; 242/558, 559, 559.1, 560, 560.1, 563

(56) References Cited

U.S. PATENT DOCUMENTS 2,961,181 A * 11/1960 Fillmann et al. ..... 242/418.1
3,815,313 A * 6/1974 Heisler ..... 53/413
3,858,819 A * 1/1975 Butler, Jr. ..... 242/552
4,391,079 A * 7/1983 Cherney ..... 53/396
4,624,096 A * 11/1986 Nordstrom ..... 53/209
4,881,695 A * 11/1989 Beisswanger ..... 242/556.1
5,138,815 A * 8/1992 Groschen, Jr. ..... 53/55
5,388,387 A * 2/1995 McElvy ..... 53/451
5,540,802 A * 7/1996 Totani ..... 156/359
5,575,135 A * 11/1996 Nordstrom ..... 53/463
5,671,593 A * 9/1997 Ginestra et al. ..... 53/504
6,067,780 A 5/2000 Gentilli et al.
6,308,497 B1 * 10/2001 Cassoli et al. ..... 53/228

FOREIGN PATENT DOCUMENTS

IT 1299896 4/2000
IT 1309317 1/2002

* cited by examiner

*Primary Examiner*—Stephen F. Gerrity
*Assistant Examiner*—Hemant M. Desai
(74) *Attorney, Agent, or Firm*—Fay, Sharpe, Fagan, Minnich & McKee, LLP

(57) ABSTRACT

A method for stopping and restarting an automatic machine (1) for wrapping products (2), in particular rolls of toilet or kitchen paper, in a collective pack (3) using a packaging film (4*a*) unwound from a first reel (31*a*). The method comprises the following automatic sequence of steps: reducing the speed of the machine (1); and stopping the feeding of the products (2) and of the film (4*a*) at suitably synchronized intervals from each other relative to the processing of the products (2). The method subsequently comprising the steps of: substituting the first reel (31*a*) of the film (4*a*) with a second reel (31*b*); loading the film (4*b*) on the second reel into feed means (33, 10 34). Restarting the machine (1) at reduced speed and thereby automatically activating the following sequence of steps: unwinding and positionally centering the film (4*b*); and restarting the feeding of the products (2) and of the film (4*a*) at suitably synchronized intervals from each other relative to the products.

9 Claims, 8 Drawing Sheets

METHOD FOR STOPPING AND STARTING AN AUTOMATIC MACHINE FOR COLLECTIVELY WRAPPING PRODUCTS, ESPECIALLY ROLLS OF TOILET OR KITCHEN PAPER

BACKGROUND OF THE INVENTION

The present invention relates to the automatic packaging of products, in particular rolls of toilet or kitchen paper, wrapped in collective packs using a film of packaging material.

The invention relates in particular to a method for stopping and restarting an automatic machine for packaging these products, advantageously used to optimize production changeover time and to minimize the number of manual operations to be performed for this purpose by personnel attending to the machine.

According to current packaging industry practices in the field of the above mentioned products, changing over to a different type of product, for example, when a programmed quantity of products has been reached, means stopping an automatic packaging machine and subjecting it to a whole range of operations in order to adapt its parts and settings to the different product. The completion of the setup and changeover procedure, however, involves numerous operations which must be performed manually and in a set order that must rigidly observed.

Basically, these operations are the following: stopping the machine; removing the products remaining from the previous production runs; setting the machine up for the new size packages to be made; filling the machine with products for the new size packages; and restarting the machine gradually before returning it to normal production speed.

More specifically, these operations include:

- manually stopping the means that feed the product to the machine;
- manually activating the function that removes the rolls of the previous production run from the feed means and from the inside of the machine itself;
- manually removing from the machine the sheets of wrapping film remaining from the previous production run;
- manually substituting the film reel from which the product wrapping sheets for the previous production run were drawn;
- manually loading the end of the film on the substitute reel into the related film feed means;
- performing a few machine cycles at reduced speed in manual, jogging mode in order to stabilize the wrapping film last loaded;
- re-starting the product feed system using the control panel and screen;
- performing a few machine cycles in manual mode in order to fill the roll feed system;
- manually removing the wrapping film sheets made during the test cycles;
- performing a few machine test cycles in manual mode; and lastly,
- manually switching to automatic mode and waiting for the machine to reach steady-state operating conditions.

The operations listed above, must be performed (some manually and others semiautomatically, for example, by jogging the machine) in a well-defined order constituting a rigid procedure that must be followed for machine setup to be as quick and effective as possible.

Procedures of this kind as guides for machine users are extremely useful tools which greatly simplify changeover operations compared to the situation existing prior to their advent.

However, manual operations or operations that must be performed under human supervision introduce a certain degree of unpredictability that may nullify these benefits. Thus, positive results may not be attained simply on account of the operator's failing to follow a procedure exactly, either deliberately or due to negligence, or, for any reason, incorrectly performing, or dedicating too much time to, one or more of the steps in the procedure, meaning that the time taken to set up and restart the machine may become unduly long, with obvious negative repercussions on production costs and scheduling.

SUMMARY OF THE INVENTION

In order to improve on this state of affairs, the invention has for an aim to provide a method that automates the changeover procedure to a much greater extent than prior art solutions and significantly reduces the number of operations that have to be performed manually.

According to the invention, this aim is achieved through a method for stopping and restarting an automatic machine for wrapping products, in particular rolls of toilet or kitchen paper, in a collective pack using a packaging film unwound from a first reel, the method comprising the following automatic sequence of steps, triggered by the activation of a machine stop control:

- reducing machine speed to a speed suitably lower than the working speed;
- stopping the infeed of the products to the machine;
- stopping the infeed of the wrapping film to the machine with a delay of at least four steps after stopping product infeed;
- stopping the machine after the products inside the machine have moved at least three steps forward;
- the method further comprising the steps of
  - substituting the first reel of wrapping film with a second reel;
  - loading the film on the second reel into the related film feed means;
  - restarting the machine and thereby automatically activating the following sequence of steps:
    - restarting wrapping film unwinding from the second reel;
    - positionally centering the wrapping film;
    - restarting the machine at a reduced speed, lower than the working speed;
    - restarting product infeed;
    - restarting the infeed of the sheets of wrapping film to the machine with a delay of at least four steps after restarting product infeed.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
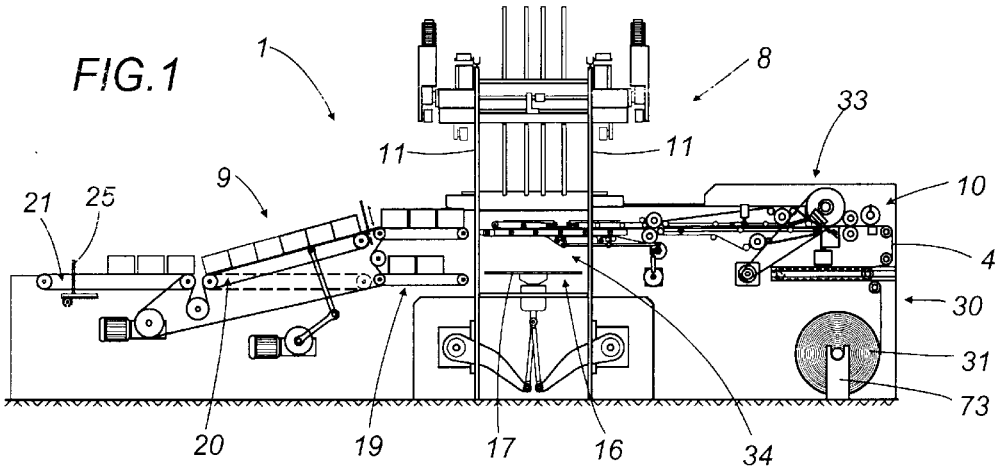
FIGS. 1 and 2 are, respectively, an elevation view and a top plan view of a wrapping machine, represented schematically.
Figure 2:
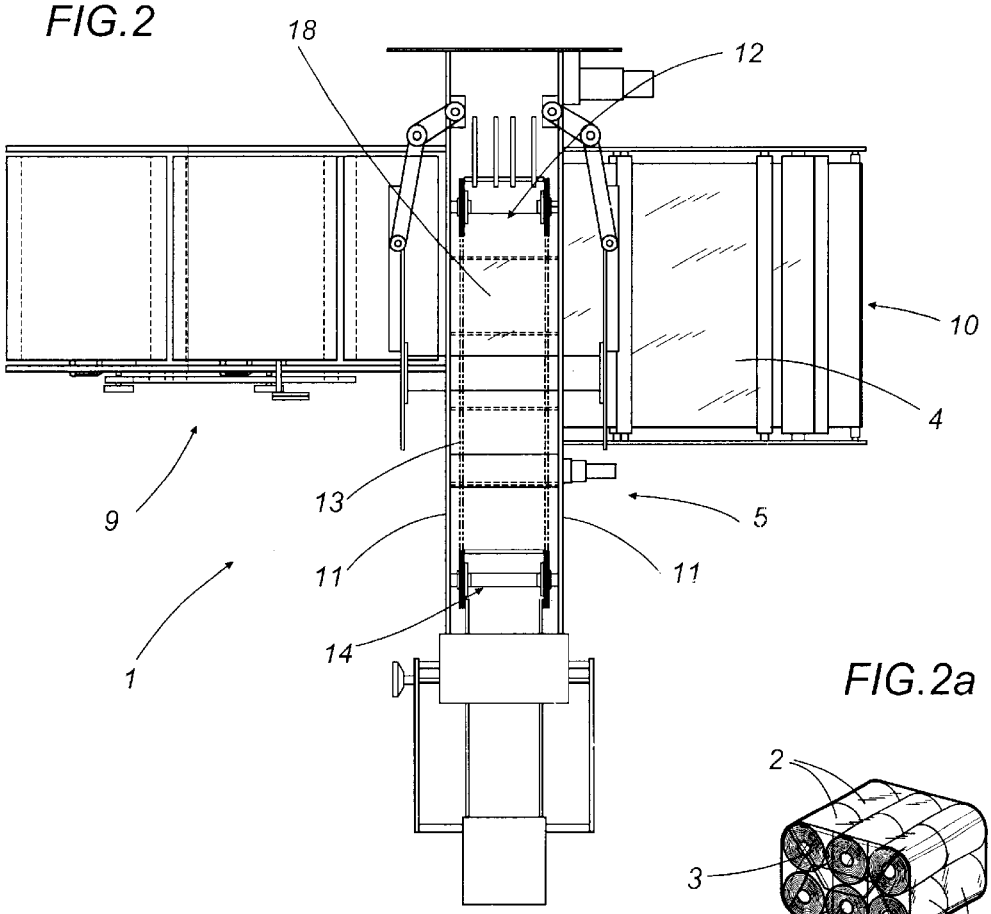
Figure 2A:
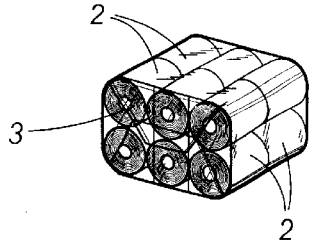
FIG. 2*a* is a perspective view of a product pack that can be made using the machine illustrated in FIGS. 1 and 2.

With reference to FIGS. 1 and 2, the numeral 1 denotes in its entirety a conventional automatic wrapping machine designed to wrap products 2, especially rolls of toilet or kitchen paper, in groups illustrated by way of example in FIG. 2*a*—where the products 2 are grouped together in a pack and collectively wrapped in a wrapping 3 made using a film 4 of packaging material suitably folded and sealed by the machine 1.

The machine 1—known from Italian patent No. 1.299.896 of Apr. 4, 2000 (application Ser. No. BO98A000149 dated Dec. 3, 1998) to the same Applicant as the present—essentially comprises: a machine body labeled 8 in its entirety; product feed means labeled 9 in their entirety; and means, labeled 10, for feeding the wrapping film.

The machine body is shaped substantially like a parallelepiped, delimited by two plane vertical parallel sides 11 and associated, on one side, with the product feed means 9 and, on the other side, with the wrapping film feed means 10.

Figure 4:
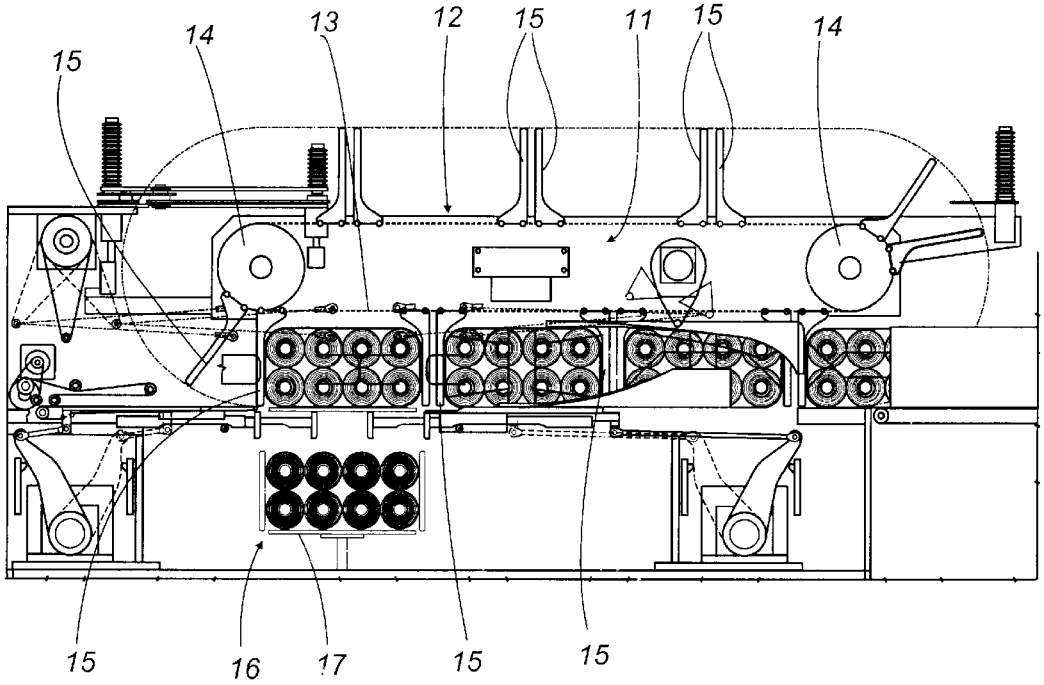
FIG. 4 is a schematic side view of a part of the machine illustrated in FIGS. 1 and 2.

The sides 11 of the machine body 8—FIG. 4—enclose an apparatus 12 for mechanically conveying the products 2 in steps between a series of operating stations in which the process for wrapping the products 2 and sealing the wrapping 3 is performed.

More specifically, the apparatus 12 comprises a pair of endless chains 13 looped around a pair of pulleys 14, one of which is power driven. The chains 13 mount a number of pushing elements 15, which project transversely from the chains 13 at regular intervals longitudinally along the chains 13.

An elevator 16, equipped with a horizontal loading table 17, is located inside the machine body 8, below the sides 11, and is reciprocatingly movable in a vertical direction between a lowered position, in which it receives the products 2, and a raised position, in which the products 2 are transferred.

When the loading table 17 of the elevator 16 is at its lowered position, the product 2 feed means 9 stack the products 2 on it. When the loading table 17 of the elevator 16 is at its raised position, it places the products 2 between pairs of consecutive pushers 15 on the apparatus 12 above it for mechanically conveying the products 2.

During the upstroke between the limit positions just described, the products 2 intercept sheets 18 of wrapping material positioned horizontally at appropriate intervals across the vertical path of the products 2 carried by the loading table 17 of the elevator 16.

As it moves upwards, the group of products 2 stacked on the loading table 17 of the elevator 16 thus captures the sheet 18 of wrapping material which covers the top and sides of the products 2. On reaching the mechanical conveying apparatus 12, the group of products 2 and the sheet 18 of wrapping material over it are transferred to it in a manner that is well within the knowledge of a person skilled in the trade and that is not described since it does not form part of the invention, after which the loading table 17 of the elevator 16 moves back down to the lowered position, ready to receive another group of products 2 and to repeat its work cycle.

Figure 3:
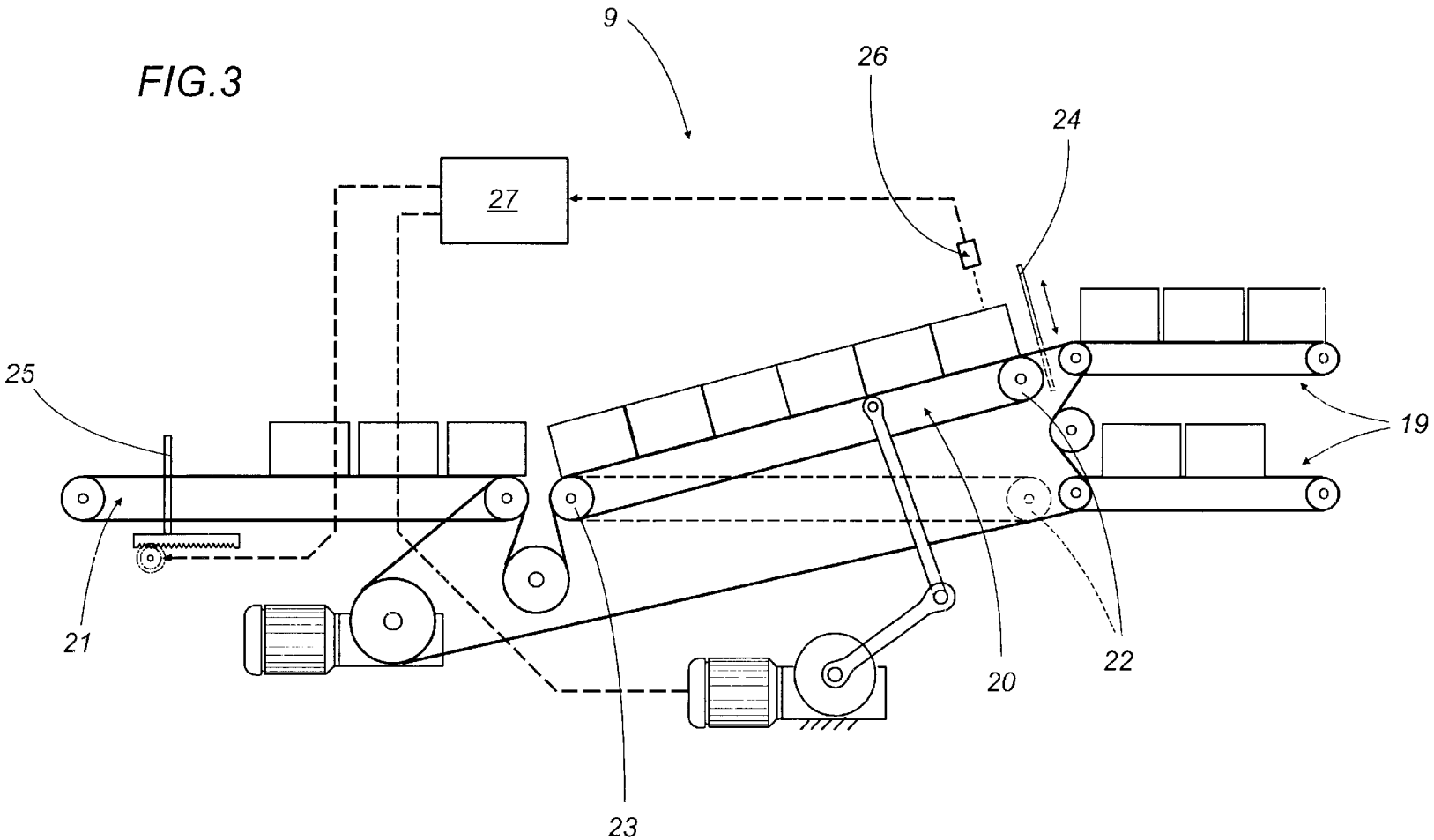
FIG. 3 is an elevation view of a part of the machine, showing a non-restricting embodiment of the means for feeding the products to the wrapping machine.

FIG. 3 shows a preferred, non-restricting embodiment of the product 2 feed means 9 [this embodiment being known from Italian patent No. 1.309.317 of Jan. 22, 2002—application Ser. No. BO99A000368 dated Jul. 2, 1999—to the same Applicant as the present]. These feed means 9 comprise a set of endless conveyor belts 19, 20 and 21 which, starting from the machine body 8 and in a direction away from it, that is to say, in a direction opposite the product 2 feed direction, comprise: a first pair of short parallel horizontal belts 19 placed one over the other; a central belt 20 mounted rotatably in a vertical plane in such a way that it can swing and thus align its outfeed end 22 to one or the other of the parallel belts 19; and a fixed horizontal conveyor belt 21 aligned with the infeed end 23 of the central belt 20.

Thanks to escapement means 24 and 25 associated with the central belt 20 and with the belt 21 that precedes it, a local control apparatus labeled 27 acting in conjunction with suitable sensors 26, keeps the parallel belts 19 and, hence, the loading table 17 of the elevator 16 supplied with products.

Figure 6:
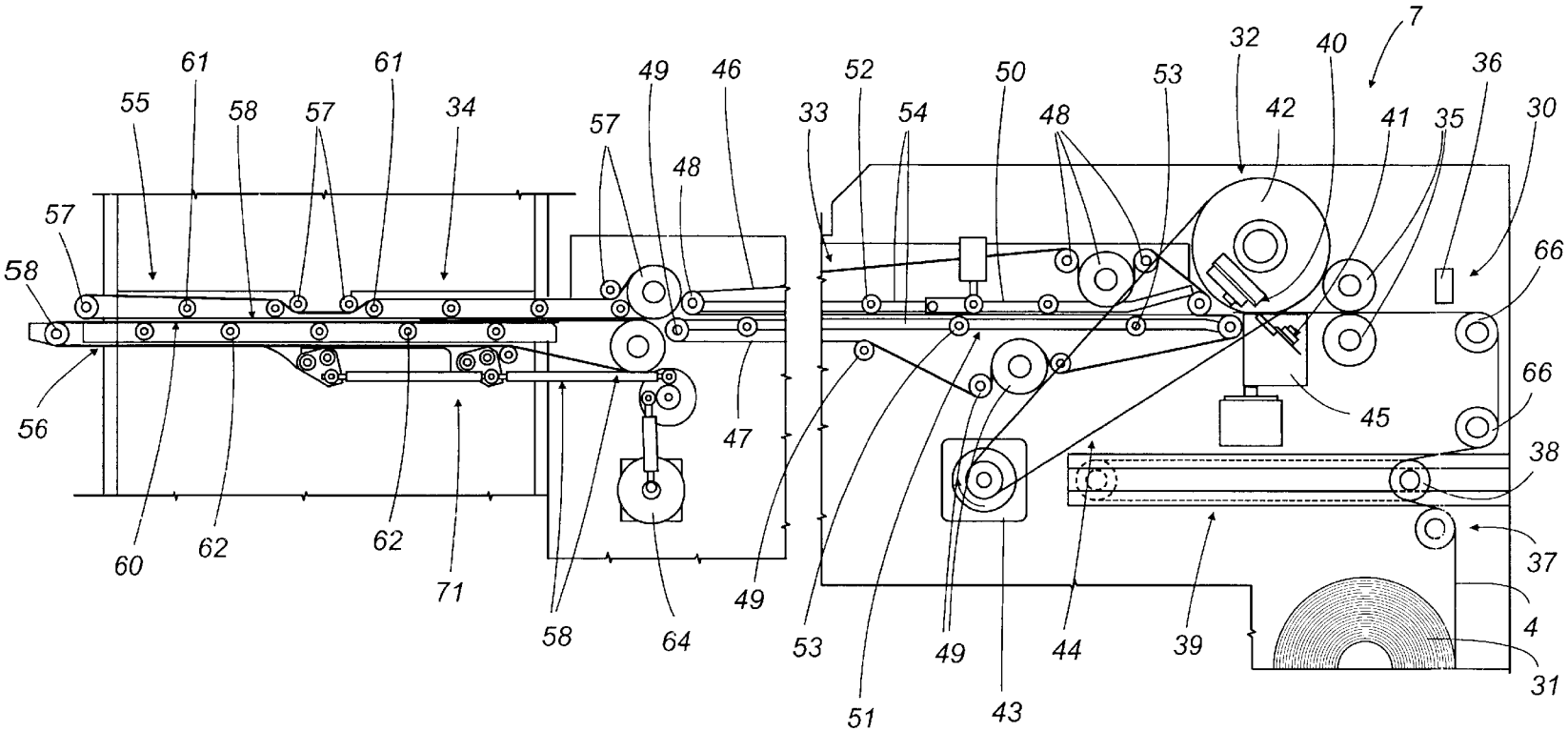
FIG. 6 is a detail view of a part of the machine of FIG. 1, showing a non-restricting embodiment of the means for feeding the wrapping film to the wrapping machine.

FIG. 6 shows a preferred, non-restricting embodiment of the wrapping film feed means 10. This embodiment, which is disclosed in Italian patent No. 1.299.896 to the same Applicant as the present, comprises: a unit 30 for unwinding a film 4 of plastic material—preferably polythene—from a reel 31; a cutting device 32; a film transporting apparatus 33; and an apparatus 34 for positioning the sheets 18 cut from the film 4.

The unwinding unit 30 comprises a pair of unwinding rollers 35 mounted on both sides of the film 4, in contact along their generatrix, and power driven in such a way as to impart on the film 4 a feed motion that unwinds it from the reel 31.

A photocell 36 associated with the unwinding unit 30 upstream of the unwinding rollers 35 detects reference marks 70 printed on the film 4 unwound from the reel 31 so that the film is cut in the desired lengths.

Figure 7:
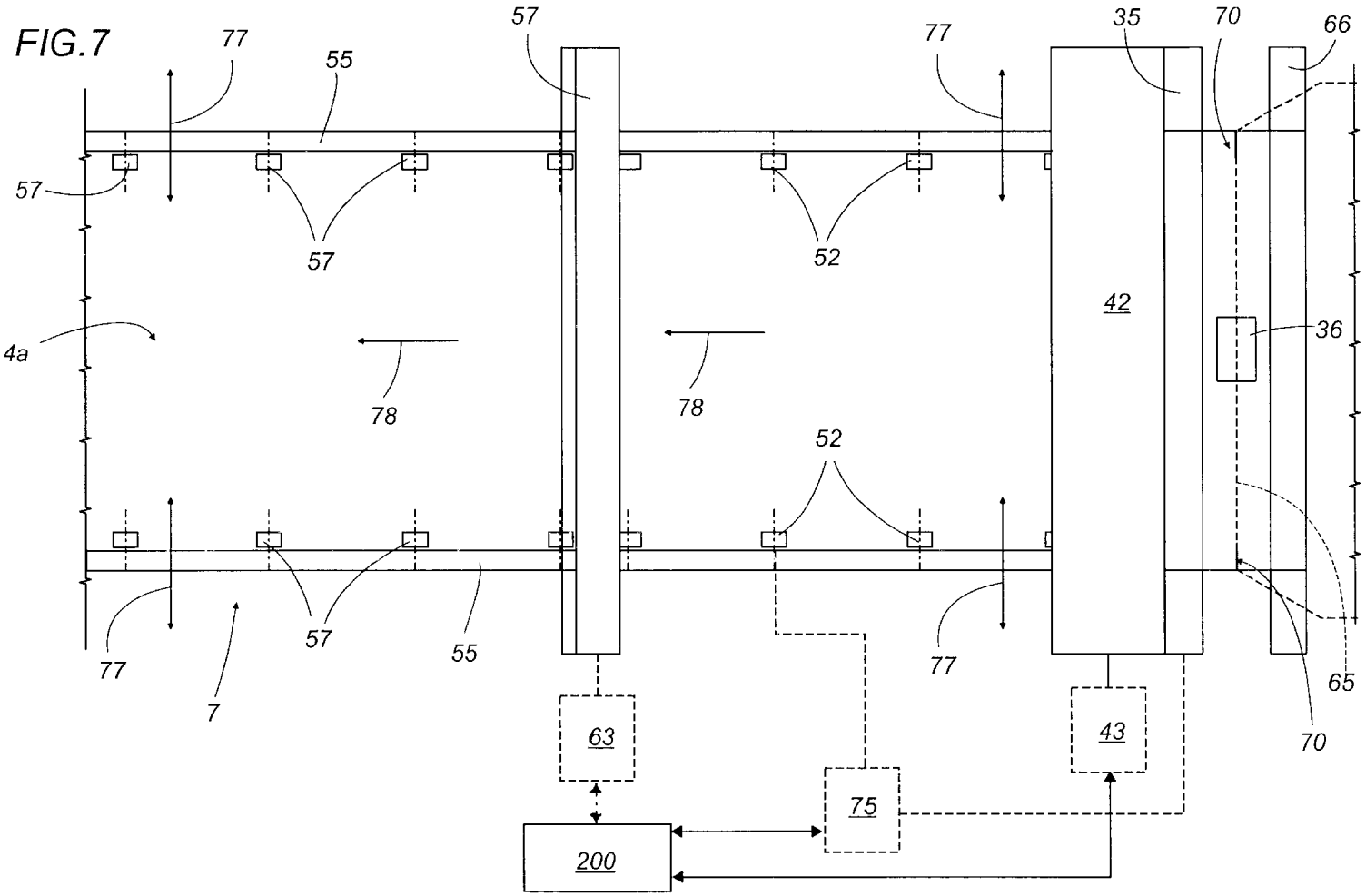
FIG. 7 is a top plan view of the feed means of FIG. 6, represented schematically with some parts cut away in order to better illustrate others.

The unwinding rollers 35 are power driven preferably by an electronic brushless motor 75—see FIG. 7—which is activated by a centralized unit 200 that controls the machine 1 in its entirety for the time needed to unwind a defined length of the film 4, the length being detected by the photocell 36.

Between the unwinding rollers 35 and the reel 31, the unwinding unit 30 includes means 37 for controlled tensioning of the film 4, which, more specifically, include fixed transfer rollers 66 and a mobile transfer (dandy) roller 38 mounted on a linear actuator and slidably housed in a linear guide 39.

The movements of the transfer roller 38 along the guide 39 are potentiometrically controlled, which means that the tensioning of the film 4 can be modulated via software by the machine 1 control means according to the physical and geometrical properties of the film 4 being used.

The cutting device 32 comprises two knives 40 and 41 embodied as blades oriented transversely to and positioned on both sides of, the film 4, and one of which has a serrated cutting edge.

The first knife 40 is mounted on a roller 42 that is rotationally driven by an electronic brushless motor 43 that transmits motion to the roller 42 through a belt 44.

The second knife 41 is mounted on a support 45 tangentially to the cutting plane of the first knife 40.

The cutting device 32 applies a perforated tear line to the film 4 which does not break the continuity of the film 4 but makes it easier to tear it into wrapping sheets 18 of suitable size at a later stage.

As shown in FIG. 6, adjustment of the cutting device 32 in order to vary the distance between two consecutive tear lines can easily be controlled through the centralized control means 200 of the machine 1 by setting a suitable correlation between the rotation speed of the first knife 40 and the feed speed of the film 4 being unwound. Thus, the faster the speed at which the film 4 is fed, the longer the wrapping sheets 18 will be for each full turn of the knife 40.

The film transporting apparatus 33 comprises two opposite transporters equipped with respective power-driven endless belts 46, 47 looped around pulleys 48 and 49 mounted in such a way as to confer on the belts 46, 47 an elongated annular configuration along the film 4.

The belts 46, 47 have transporting sections 50, 51 which bilaterally grip the interposed film 4, causing it to move from an infeed area close to the cutting device 32 towards an outfeed area close to the positioning apparatus 34.

The transporting sections 50 and 51 of the belts 46 and 47 are opposed from the inside of the respective annular configurations by a series of presser rollers 52 and 53 mounted on supports 54.

The presser rollers 52 and 53 are offset from each other lengthways along the film 4 and are mounted in such a way as to interfere at right angles to the transporting sections 50 and 51 so as to confer on the film 4 a longitudinally undulated form designed to facilitate feeding of the film 4 by friction.

The belts 46 and 47 just described constitute guide means designed to make the film 4 move in a direction of feed indicated in FIG. 7 by an arrow 78.

The positioning apparatus 34—FIG. 6—extends in line with the transporting apparatus 33 and goes through the machine body 8 below the sides 11.

Looking in more detail, the positioning apparatus 34 comprises two opposite power driven endless belts 55 and 56 wound around pulleys 57, 58 to form horizontally elongated loops lengthways along the film 4.

The belts 55 and 56 are opposite each other at transporting sections 59, 60 which are pressed against each other from both sides of the film 4 by rollers 61, 62 in such a way as to make it move along horizontally until it reaches the vertical path of the elevator 16.

The belts 55 and 56—which also embody means for guiding the film 4—are power driven by a motor 63 and move at a variable speed, tangential to the film 4, that may be much higher than the speed of the film 4 along the transporting apparatus 33 which, on the contrary, moves at a constant speed. The lower belt 56 is supported by a four-bar linkage 71 driven by a motor 64. The driving action of the motor 64 enables the linkage 71 to move the lower belt 56 away from the upper belt 55 so as to slacken the hold which the two belts 55 and 56 have on the film 4.

By accelerating the belts 55, 56 of the positioning apparatus 34 relative to the belts 46 and 47 of the transporting apparatus 33, the film 4 is torn into sheets 18, each delimited by two consecutive tear lines, at the zones where the film 4 is held simultaneously both by the belts 46 and 47 of the transporting apparatus 33 and by the belts 55 and 56 of the positioning apparatus 34. Each sheet torn off the film 4 is carried by the positioning apparatus 34 as far as the vertical path of the elevator 16, whereupon the motor 63 that drives the positioning apparatus 34 is stopped.

Next, the four-bar linkage 71, driven by the motor 64, moves the lower belt 56 away from the upper belt 55, and the sheet of film released from the hold of these two belts, is: intercepted by the pack of products 2 being lifted by the elevator 16; pulled out of the positioning apparatus 34; and finally transferred, together with the products 2, to the part of the machine body 8 above, where the remaining steps of the wrapping cycle are carried out.

In order to be able to process film 4 of different sizes, as shown in FIG. 7, the successive pairs of belts 46, 47 and 56, 57—belonging to the transporting apparatus 33 and to the positioning apparatus 34, respectively—are designed to allow the distance between the pairs of belts to be varied in a direction 77 transversal to the film 4 feed direction 78.

Figure 5:
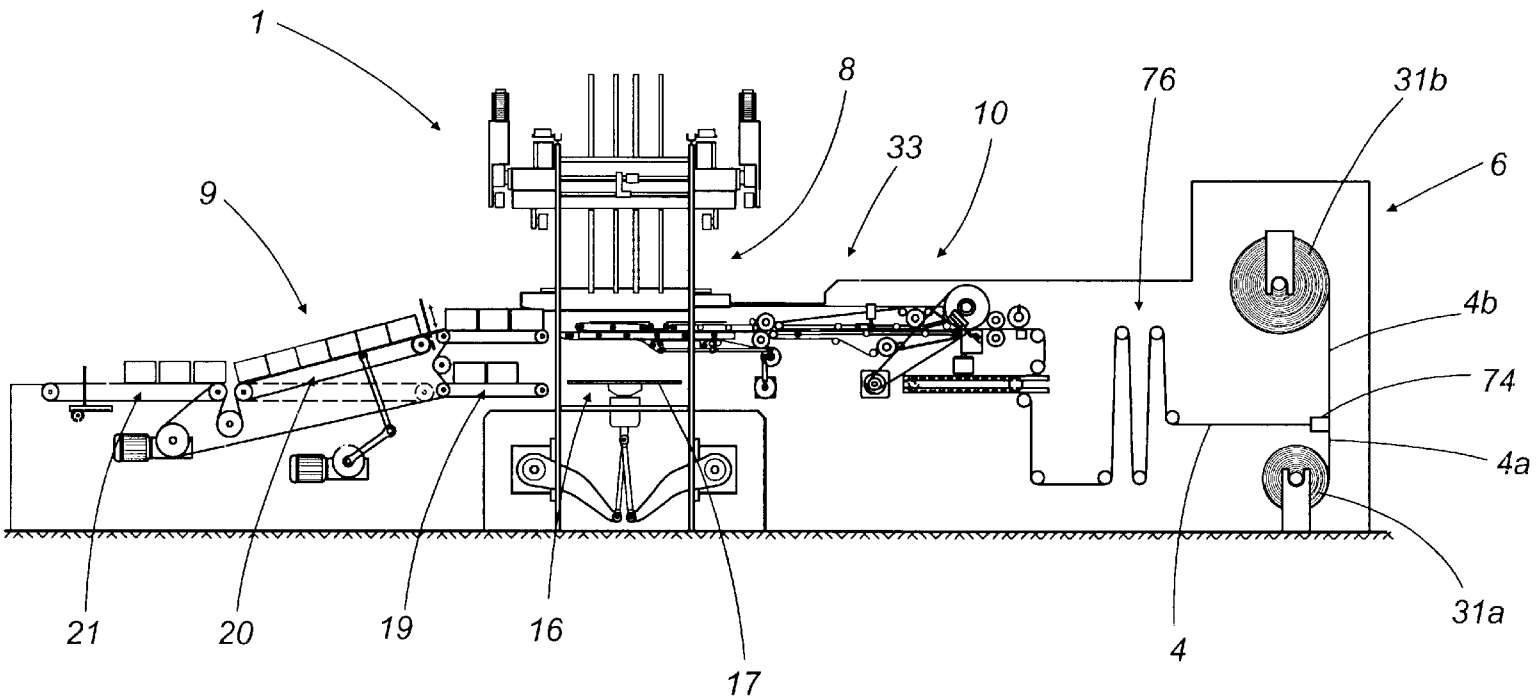
FIG. 5 illustrates a first alternative embodiment of the machine of FIG. 1.

A comparison between FIGS. 1 and 5 reveals that, in the embodiment illustrated in FIG. 1, a depleted film reel 31 can be substituted manually by removing the reel 31 from its bracket 73 and mounting a substitute reel 31 in its place, whereas the alternative embodiment illustrated in FIG. 5 features an apparatus 6 especially designed to substitute the reel fully automatically.

For this purpose, the apparatus 6, which is per se well known to experts in the trade, comprises two reels 31*a* and 31*b*; a work head 74 divided into two parts operatively associated to the films 4*a*, 4*b* unwound from the two reels 31*a*, 31*b*, respectively; and transfer means 76 which connect the film 4 feeding out of the work head 74 to the means 10 that feed the film 4 to the machine 1.

Below is a brief description of the way the automatic apparatus 6 works. When the film 4*a* on one of the reels, for example the lower reel 31*a*, is nearly finished, a suitable exchange of signals between the reel 31*a* and the controller of the work head 74 triggers the part of the work head 74 associated with the film 4*b* on the upper reel 31*b* in order to attach the front end of the substitute film 4*b* with bi-adhesive tape to the trailing end of the depleted film 4*a*; after which the work head 74 cuts the film 4*a* from the reel 31*a* and feeding of the film 4 continues from the upper reel 31*b*.

The transfer means 76 create a sort of reservoir enabling the film 4 to continue feeding to the machine 1 without interruption and without reducing the speed at which the film 4 is fed.

Figure 8A:
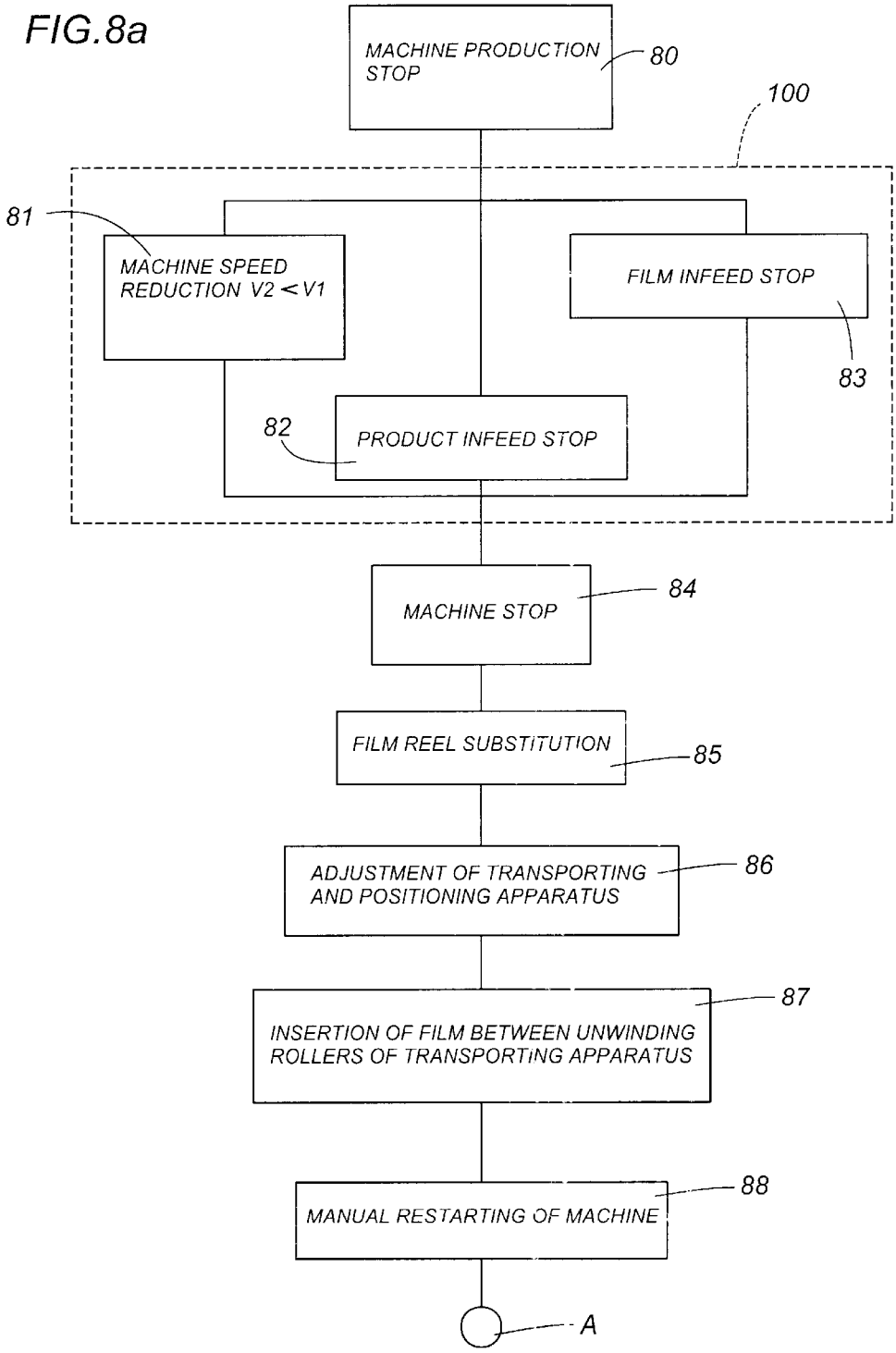
FIGS. 8*a* and 8*b* are block diagrams representing a preferred embodiment of a procedure for stopping and restarting the machine of FIG. 1.
Figure 8B:
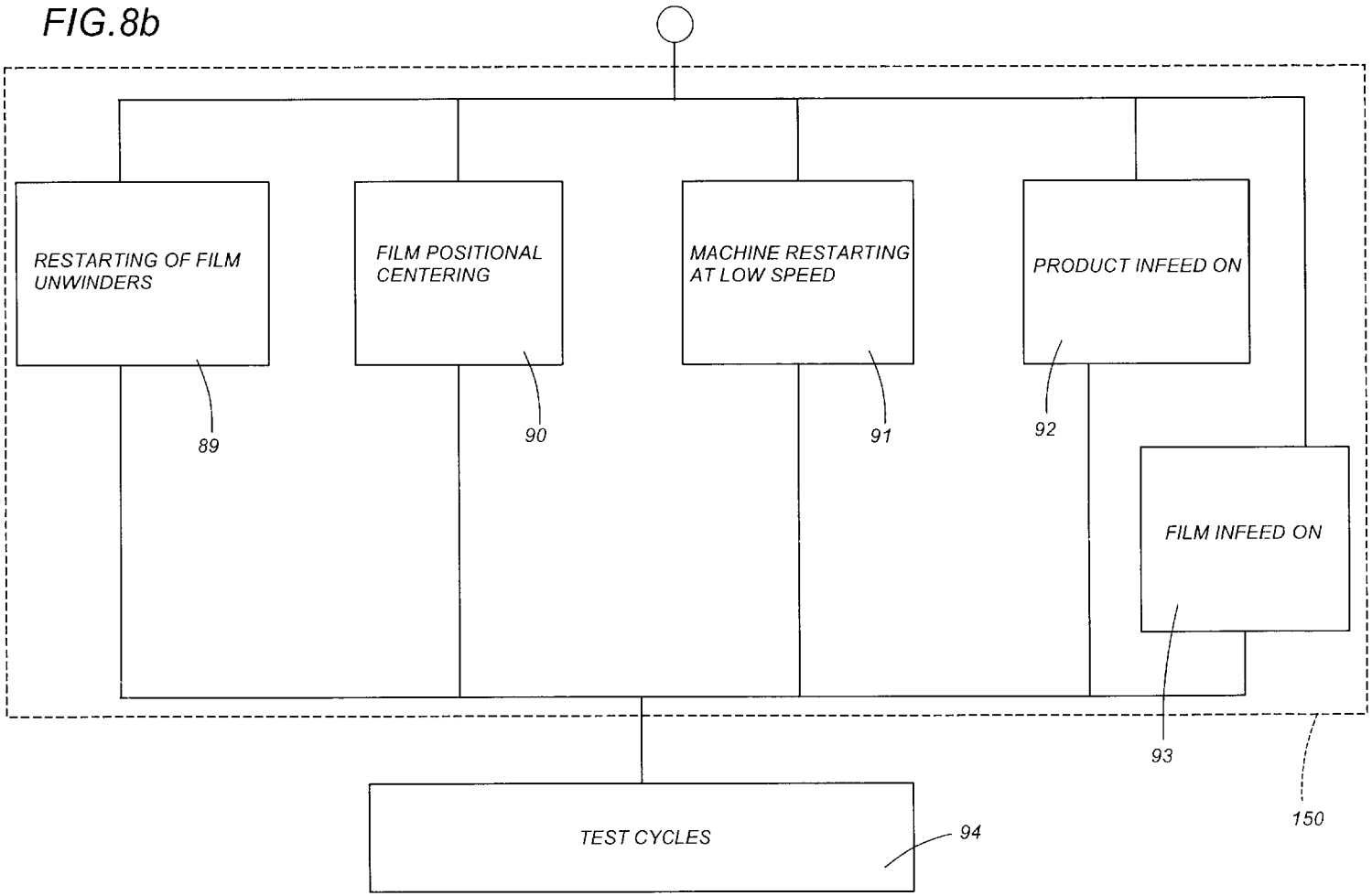

The machine 1, whose general structure is outlined above, can be used to implement a stopping and restarting procedure—allowing rapid changeover to products of a different size, that is to say, changing the wrapping film in an extremely simple manner that minimizes down time—which, in a first preferred embodiment schematically represented in the block diagrams of FIGS. 8*a* and 8*b*, comprises the following steps:

stopping production with the machine [block 80] through a command issued manually by the operator from a suitable control panel; this command having the effect of triggering a sub-program—labeled 100—residing, for example, in the means 200 for controlling the machine 1, and designed to perform the following steps fully automatically:

reducing the speed of the machine 1 [block 81] from production speed V1 to an appreciably lower speed, for example, to a speed V2 of around 20 cm/min;

stopping the means 9 for feeding the products 2 [block 82] with a delay, after reducing machine speed as just mentioned, of 4–5 steps of the conveying apparatus 12 continuing to feed the products 2 within the machine body 8; and stopping film 4*a* feed, that is to say, stopping the motor 75 that unwinds and feeds the film 4*a* in the transporting apparatus 33 [block 83]; this stop being effected with a delay of 3–4 steps of the conveying apparatus 12 continuing to feed the products 2;

Once this sub-program has been completed [block 100] the procedure returns to the direct control of the operator, who:

stops the machine 1; and proceeds to manually changing the reel 31*a* with a reel 31*b* of substitute film 4*b* [block 85];

adjusting the distance between the guide means 46, 47 and 55, 56 of the transporting apparatus 33 and of the positioning apparatus 34 to the size of the substitute film 4*b* [block 86];

manually inserting the substitute film 4*b* [block 87] between the unwinding rollers 35 of the film transporting apparatus 33; and manually restarting the machine [block 88]; the start command also starting a second automatic sub-program 150, also residing in the means 200 that control the machine 1.

The second sub-program 150 performs the following steps:

starting the automatic unwinding of the substitute film 4*b* [block 89];

positionally centering the references 70 of the substitute film 4*b* [block 90];

restarting the machine 1 at low speed V2 [block 91], for example, again approximately 20 cm/min;

restarting the product feed means 9 [block 92]; and starting the feeding of the film 4*b* [block 93] with a delay of 4–5 cycles after restarting product feed.

Once the second sub-program 150 has been completed, the procedure returns once again to the control of the operator who performs a few product 2 wrapping cycles in manual mode at low speed V2 [block 94] in order to check that the entire system is functional and ready to resume work at production speed V1.

Compared to prior art, the procedure described above significantly reduces the number of steps that need to be carried out manually, passing from 11 steps to just 4 steps, with obvious advantages in terms of reduced down time, since the procedure is performed more quickly, and with less chance of human error.

However, by varying the structure of the machine 1 according to the embodiment illustrated in FIG. 5, the procedure can be simplified even further, with a further reduction in the number of steps to be carried out manually, so that, returning to the block diagram of FIG. 8*a*, it is at once clear that the apparatus 6 for automatically substituting the film 4*a* with the film 4*b* makes it possible to: perform automatically the steps of substituting the reel 31*a* with the reel 31*b* [block 85] and of inserting the film 4*b* between the unwinding rollers 35 of the transporting apparatus 33 [block 87].

Moreover, if the changeover to another product does not involve changing the wrapping film 4*a* with a wrapping film 4*b* of a different width, assuming for example, that the new packs to be made can be wrapped with the same film by simply changing the length of the sheets 18, then the steps of adjusting the guide means of the 46, 47, 55, 56 of the transporting apparatus 33 and of the positioning apparatus 34 [block 86] can be dispensed with.

That means a further reduction in the number of operations to be performed manually, reducing the operator's task to simply starting some of the steps in the automatic procedure and checking that the procedure is carried out correctly.

In this case, however, there remains the disadvantage of having to continue to use wrapping film of the same width, which, although it allows packaging of a certain number of different types of packs, means that the procedure does not apply to a changeover where the new product necessarily involves use of a wrapping film having a different width.

Thus, in such a case, it is evident (see FIG. 7 and block diagrams of FIGS. 8*a* and 8*b*] that once the first sub-program 100 and block 84 have been completed, the performance of block 85 by the operator involves not only changing the first film reel 31*a* with a second substitute reel 31*b*, but also manually splicing the substitute film 4*b* to the previous film 4*a* and cutting the protruding edges created by the different width of the two spliced films 4*a* and 4*b*. At this point, the performance of block 86 by the operator involves manually adjusting the distance between the guide means 46, 47 and 55, 56: first of the transporting apparatus 33 and then of the positioning apparatus 34; manually pulling the film 4*a* to be substituted until the substitute film of different width is securely held by the belts 46, 47 and 55, 56 of the transporting apparatus 33 and of the positioning apparatus 34; after which the sub-program 150 can finally be started in order to complete the procedure according to the block diagrams of FIGS. 8*a* and 8*b*.

In order to overcome this drawback, the procedure according to the invention can be further improved by providing the transporting apparatus 33 and the positioning apparatus 34 of the film 4 with suitable drive motors and by controlling these motors in a suitable manner.

Thus, assuming that the operator has performed the cycle illustrated in FIGS. 8*a* and 8*b* from the initial block 80 through to block 85 in exactly the same way as described above, that is to say, assuming that the operator has already: manually changed the reel 31*a* with the reel 31*b*; manually spliced the film 4*a* to the substitute film 4*b* using bi-adhesive tape to attach the trailing end of the former to the front end of the latter; and manually cut the corners of the wider film where it is spliced to the narrower film; and assuming that the motors 63 and 75 that drive the drive pulleys 35 and 57 of the film transporting apparatus 33 of the film sheet positioning apparatus 34—that is to say, the pulleys that drive the rollers connected to them—can be disengaged from the film by suitable clutches, the operator can turn film feed drive on and off and jog the motors 63 and 75 in such a way as to feed the two spliced films 4*a* and 4*b* along the feed path 78 without manually operating on them.

Thus, the operator can operate the two motors 63 and 75 normally until the splicing line 65 between the two films 4*a* and 4*b* is in the proximity of the transporting apparatus 33 [FIG. 7]. At this point, by acting on the clutch of the motor 75 in such a way as to disengage the guide means 46 and 47 of the transporting means 33 from the film 4*a*, the guide means themselves can be moved transversely to the feed direction 78 of the film 4*a*, 4*b* so as to adjust the distance between them according to the width of the substitute film 4*b*. By doing this, the drive motion used to feed the two spliced films 4*a* and 4*b* is provided entirely by the motor 63 of the positioning apparatus 34. Under these conditions, the two spliced films 4*a* and 4*b* are fed forward until the splicing line 65 between them reaches the infeed end of the positioning apparatus 34.

At this point, after disengaging the two drive motors 63 and 75 of the two films 4*a* and 4*b* by acting on their clutches, it is possible to adjust the distance of the positioning apparatus 34 guide means, that is to say, the distance between the belts 55 and 56, according to the width of the film 4*b*. The film 4*a* to be substituted is thus disengaged from the belts 55 and 56, whilst the substitute film 4*b* behind it is simultaneously held both by the transporting apparatus 33 and by the positioning apparatus 34. Since the tear line, which has in the meantime been made by the knives 40 and 41 as the spliced films 4*a* and 4*b* move forward together, is certainly located at the positioning apparatus 34, it is possible to manually tear off the film 4*a* to be substituted which has in the meantime been disengaged from the guide means 55 and 56, leaving only the substitute film 4*b*, which is by this time well inserted between the drive pulleys 57 and 58 of the sheet positioning apparatus 34 ready for the wrapping cycle to be continued.

At this point, the operator can resume the procedure from block 88 and start the second automatic sub-program 150 as described above.

Thus, the method just described eliminates the need for all the manual steps of adjusting the width of the film transporting apparatus 33 and of the film sheet 18 positioning apparatus 34 and of loading the substitute film 4*b*.

The invention described has evident industrial applications and can be subject to modifications and variations without thereby departing from the scope of the inventive concept.

In this connection, it should be stressed that yet another improvement to the invention in order to further automate the procedure can be made by setting a suitable correlation between the current position of the splicing line 65 between the two films 4*a*, 4*b* and the adjustment of the transporting apparatus 33 and of the positioning apparatus 34.

Thus, by implementing a control system capable of automatically reading the current position of the splicing line 65 relative to a predetermined reference system, and establishing a relation between this control system and the machine control means 200 in such a way as to issue signals for driving the actuators of the guide means 33, 34, 55, 56 of the film 4*a*, 4*b*, it is possible to fully automate the adjustment operations so that adjustment is remotely controlled in process when the splicing line 65 reaches certain defined positions along the feed path 78 of the film 4*a*, 4*b*.

What is claimed is:

1. A method for stopping and restarting an automatic machine (1) for wrapping products (2), in particular rolls of toilet or kitchen paper, in a collective pack using a wrapping film (4*a*; 4*b*) unwound from a reel (31*a*; 31*b*), the method comprising the following automatic sequence of steps, triggered by the activation of a control for stopping the machine (1):

reducing speed of the machine (1) to a speed (V2) suitably lower than the working speed (V1);

stopping infeed of the products (2) to the machine (1);

stopping infeed of a first wrapping film (4*a*) to the machine (1) with a delay of at least four steps after stopping the infeed of the products (2);

stopping the machine (1) after the products (2) inside the machine (1) have moved at least three steps forward;

the method further comprising the steps of:

substituting the second first reel (31*a*) of the first wrapping film (4*a*) with a second reel (31*b*) of a second film (4*b*);

loading the film (4*b*) of the second reel (31*b*) into the related film feed means (33, 34);

restarting the machine (1) and thereby automatically activating a sequence of steps including:

restarting the second wrappng film (4*b*) unwinding from the second reel (31*b*);

positionally centering the wrapping film (4*b*);

restarting the machine (1) at a reduced speed (V2), lower than the working speed (V1);

restarting the product (2) infeed;

restarting infeed of sheets (18) of the second wrapping film to the machine with a delay of at least four steps after restarting the product (2) infeed.

2. The method according to claim 1, wherein the steps of substituting the first reel (31*a*) with a second reel (31*b*) and loading the film (4*b*) from the latter into the film feed means (33, 34) are performed manually.

3. The method according to claim 2, wherein the steps of substituting the second reel (31*b*) and loading the film (4*b*) into the film feed means (33; 34) are performed when at least the size of the wrapping film sheets (18) is varied.

4. The method according to claim 1, wherein the steps of substituting the second reel (31*b*) and loading the film (4*b*) from the latter into the film feed means (33, 34) are performed by an automatic apparatus (6) which is activated by a signal relating to the state of the film (4*a*) on the first reel (31*a*).

5. The method according to claim 1, wherein the steps of substituting the second reel (31*b*) and loading the film (4*b*) into the film feed means (33; 34) are performed when at least the size of the wrapping film sheets (18) is varied.

6. The method according to claim 5, comprising a step of checking the current position of the splicing line (65) relative to a predetermined reference system, where the splicing line (65), upon reaching a predetermined position in the feed direction (78), causes a signal to be issued in order to activate suitable actuating means used to automatically adjust the distance between means (33, 34, 55, 56) for guiding the film (4*a*; 4*b*) towards the machine (1).

7. The method according to claim 6, wherein the signal stops the feeding of the film (4*a*; 4*b*) in the feed direction (78) to restart at a later stage when the distance between the guide means (33, 34; 55, 56) has been suitably adjusted.

8. The method according to claim 7, wherein the actuating means comprise at least one drive motor (63; 75) for feeding the film (4*a*; 4*b*) and equipped with means enabling engagement and disengagement of film (4*a*; 4*b*) feed.

9. The method according to claim 5, wherein the steps of substituting the first reel (31*a*) with a second reel (31*b*) and loading the film (4*b*) from the latter into the film feed means (33; 34) comprise a splicing step in which the film (4*a*) from the first reel (31*a*) and the second film (4*b*) from the second reel (31*b*) are joined along a splicing line (65) and proceed together lengthways in a direction (78) in which the films (4*a*; 4*b*) are fed.

* * * * *